United States Patent [19]

Thompson

[11] Patent Number: 4,478,552

[45] Date of Patent: Oct. 23, 1984

[54] METHOD AND APPARATUS FOR FAN BLADE TIP CLEARANCE

[76] Inventor: Stanley E. Thompson, 15710 Old Redwood Hwy., Healdsburg, Calif. 95448

[21] Appl. No.: 439,914

[22] Filed: Nov. 8, 1982

[51] Int. Cl.[3] ..... F03D 11/00

[52] U.S. Cl. ..... 415/174; 415/197; 29/156.8 CF

[58] Field of Search ..... 415/172 A, 174, 196, 415/197; 29/156.8 CF, 156.4 WL, DIG. 6; 83/184

[56] References Cited

U.S. PATENT DOCUMENTS

| | | | |
|---|---|---|---|
| 2,840,343 | 6/1958 | Brandt et al. | 415/174 |
| 3,423,070 | 1/1969 | Corrigan | 415/174 |
| 3,689,971 | 9/1972 | Davidson | 29/156.8 CF |
| 3,799,128 | 3/1974 | Small | 415/174 |
| 4,207,024 | 6/1980 | Bill et al. | 415/196 |

*Primary Examiner*—John W. Shepperd
*Assistant Examiner*—Renee S. Kidorf
*Attorney, Agent, or Firm*—Dressler, Goldsmith, Shore, Sutker & Milnamow, Ltd.

[57] ABSTRACT

A method and apparatus for adjusting the amount of clearance between the tips of the blades of a large axial flow fan and the inner surfaces of the fan cylinder wall. A plurality of foam spacer panels are secured to the inner surfaces of the fan cylinder walls. A cutting means is attached to the outer end of the longest fan blade and extends a short distance outwardly therefrom. Rotation of the fan causes the cutting means to trim the spacer panels to achieve the required clearance. A plurality of plastic sheets are secured to the spacer panels in covering relationship thereto.

6 Claims, 8 Drawing Figures

20
34
38
26
19
30
2.
2.
10
32
28
21
15
13
12
11
24(a)
16
24
24(b)
23
18
17

20
34
32
26
70
30
36
38
34
30
32
38
34

44
50
32
58
56
68
60
61
56
58
62
52
36
46
42
48

METHOD AND APPARATUS FOR FAN BLADE TIP CLEARANCE

BACKGROUND OF THE INVENTION

This invention relates to air moving mechanisms of the type which have particular utility in heat exchange equipment such as water cooling towers. In particular, the invention relates to a unique method and apparatus for adjusting the amount of clearance between the tips of the blades of a large axial flow fan and the inner surfaces of the fan cylinder wall.

In a conventional evaporative water cooling tower of the induced draft type, a single propeller-type fan is rotatably mounted within a fan cylinder to draw air through a fill section positioned therebelow, which air is vertically discharged from the fan cylinder into the atmosphere. Water to be cooled is gravitationally delivered through the fill section in intersecting relationship with the air drawn through the section by the fan. These cylinders generally have a venturi type construction at a point adjacent to and in direct alignment with the plane of rotation of the fan. The inner surface of the cylinder is preferably of a smooth aerodynamically designed configuration. The streamlining of the inner surface of the cylinder wall is desirable in order to decrease friction and air drag and the venturi construction is provided to assure maximum air flow through the tower as well as maximum exhaust air speed out of the tower.

The fans for large capacity cooling towers often are twenty eight feet in diameter or more to move sufficient air to effectively cool the extremely large quantities of water handled by these towers. Manifestly, blades for fans of this diameter must be of sufficient strength to not only withstand cantilever mounting thereof but also resist sufficient deflection during operation. Large cast metal or glass fiber reinforced synthetic resin members of relatively high weight have been found to be the most satisfactory materials for constructing such fan blades.

The provision of a venturi type fan cylinder for a cooling tower and the advantages derived therefrom is of common knowledge to those skilled in the cooling tower field. In this connection, it is also known that the fan blades must be positioned extremely close to the inner surfaces of the fan cylinder wall in order to take full advantage of the inherent properties of the venturi. In most situations it is desirable that the tips of the fan blades are less than one inch from the inner surfaces of the fan cylinder wall. As one might expect, it has been found to be most difficult to manufacture and install blades and fan cylinders to such close tolerances. The fan cylinder is usually constructed of wood, fiberglass or concrete and is most difficult to manufacture perfectly round. Further, it is most difficult to ensure that the fan is concentrically mounted within the fan cylinder. To the extent that the failure to achieve design tolerances results in the clearance between the tips of the fan blades and the surfaces of the fan cylinder wall to exceed the optimum distance, air is caused to flow over the tips of the blades into a low pressure area beneath the fan. This recirculation of air around the tips of the fan blades reduces the net amount of air moved across the plane of the fan and reduces fan efficiency.

It has been known to compensate for the practical problem of achieving design clearance between the tips of the fan blades and the fan cylinder by securing a one inch thick aluminum honeycomb material bonded to a fiberglass sheet to the surfaces of the cylinder, with the honeycomb material in facing relationship to the fan blades. A roller arrangement is secured to the tip of the fan blade and upon rotation thereof the honeycomb material is crushed into the proper shape to achieve the desired fan blade tip clearance. In practice it has been found that the aluminum material tends to corrode and it is very difficult to apply an effective sealer to the honeycomb material. Further, since the honeycomb material does not conform to the curvature of the fan cylinder, it is necessary to install shims to fill the void spaces. This is very time consuming and expensive.

SUMMARY OF THE INVENTION

In accordance with the method and apparatus of the present invention the amount of clearance between the tips of the fan blades and the fan cylinder walls is adjusted by securing a plurality of foam spacer panels to the inner surfaces of the fan cylinder walls in facing relationship to the fan blades. A cutting means is attached to the outer end of the longest fan blade and extends a short distance outwardly therefrom. Upon rotation of the fan the cutting means trims each of the spacer panels to achieve the desired clearance between the tips of the fan blades and the spacer panels. The length of each of the spacer panels is preferably substantially equal to the distance between the cutting means and the trailing edge of the adjacent fan blade in the direction of fan rotation. Each of the spacer panels is secured to the inner surface of the fan cylinder and trimmed by the cutting means one at a time in a sequential manner around the circumference of the fan cylinder.

In accordance with the preferred form of the invention the cutting means is the cutting blade of a band saw, which is secured to the longest fan blade and extends radially outward therefrom by a distance generally equal to the preselected tip clearance.

A plastic sheet is secured to the spacer panels in covering relationship to the trimmed surfaces thereof. The adjacent plastic sheets are preferably spaced a short distance apart to allow for expansion and contraction of such sheets. A sealant material is preferably applied over the top surface of each of the spacer panels. The spacer panels and plastic sheets are rigidly secured in place by fastener means which extend through the plastic sheets and the spacer panels and the wall of the fan cylinder. The spacer panels are preferably made from a polyethylene foam material and the plastic sheets are preferably made from a fiberglass material.

DESCRIPTION OF THE PREFERRED EMBODIMENTS

Figure 1:
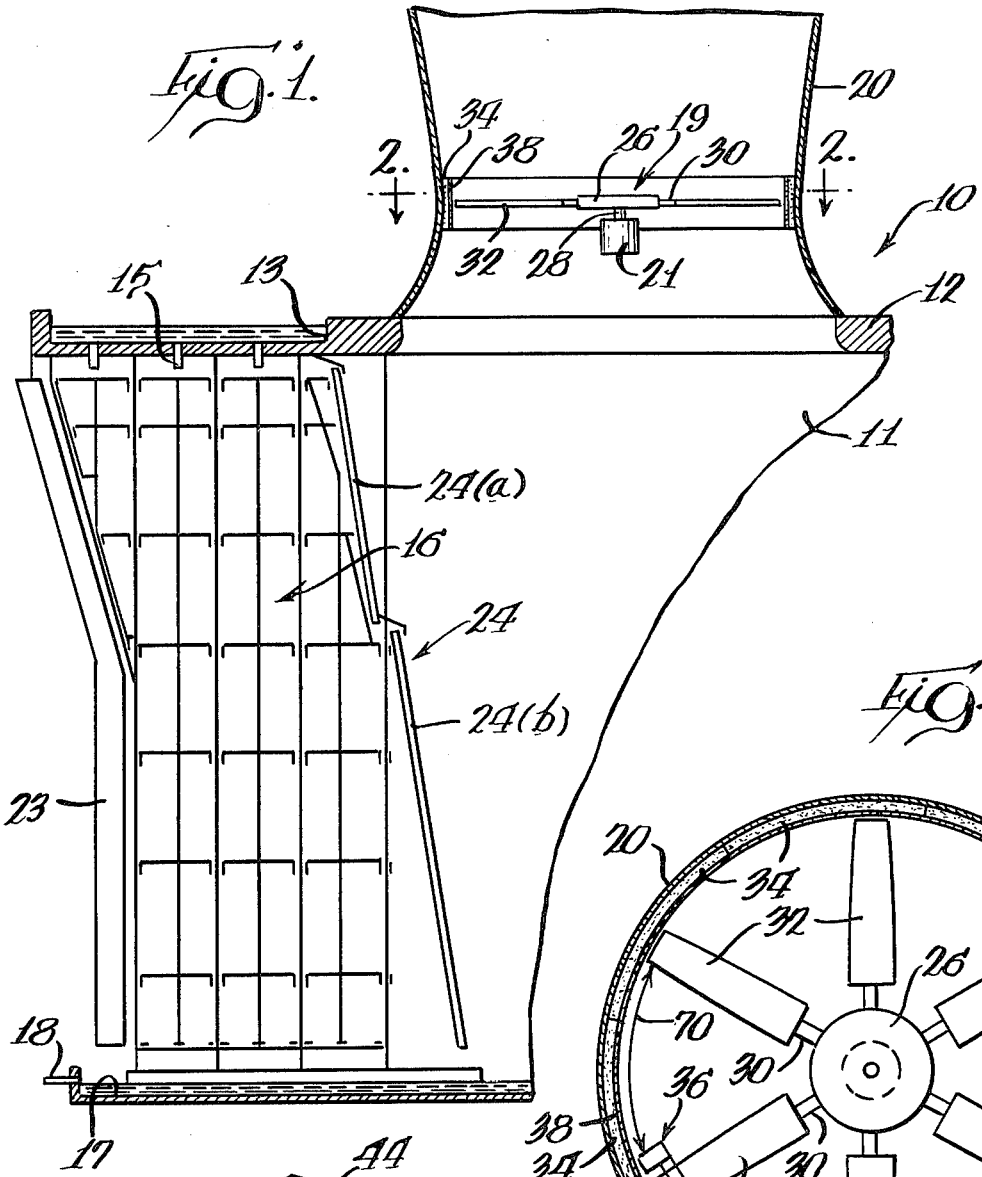
FIG. 1 is a partial sectional view taken through a representative crossflow cooling tower having a fan assembly of the type adapted to use the method and apparatus of the present invention.

Referring to FIG. 1, a crossflow cooling tower 10 is shown as having a housing 11 incorporating a top 12 defining a hot water distributing pan 13. Liquid, such as water to be cooled is pumped into pan 13 from which the liquid drains via suitable nozzles 15. After descending through the splash fill area 16, the liquid is collected in basin 17 for removal at outlet 18.

A fan assembly 19, rotatable in fan cylinder 20 by drive 21, draws air laterally through the tower for upward discharge via cylinder 20. The air passes successively through openings between housing side inlet louvers 23, the fill area 16 and through drift eliminator 24. In FIG. 1 the eliminator louvers appear in two groups, 24*a* and 24*b*.

Figure 2:
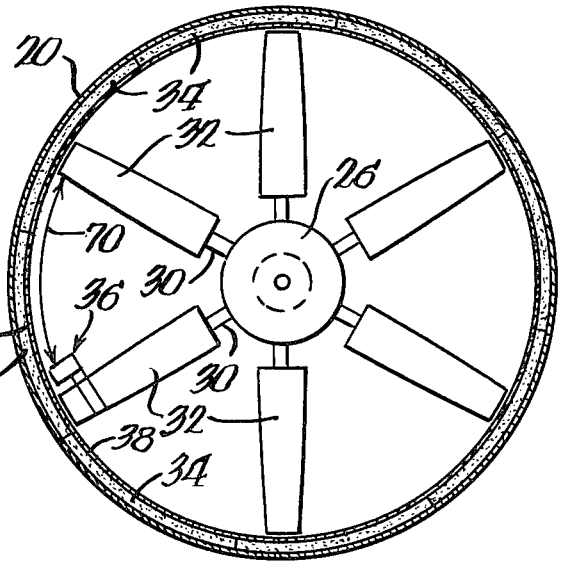
FIG. 2 is an enlarged sectional view taken along line 2—2 in FIG. 1.

Referring to FIGS. 1 and 2, fan assembly 19 includes a hub 26 which is connected to a shaft 28, which in turn is rotated by a motor associated with drive 21. A plurality of support arms 30 extend outwardly from hub 26 and a fan blade 32 is rigidly secured to each of the arms 30.

As best seen in FIG. 1, the fan cylinder preferably has a venturi type construction in direct alignment with the fan assembly 19. The method and apparatus of the invention is directed towards the adjustment of the amount of clearance between the tips of the fan blades 32 and the inner surfaces of the fan cylinder 20. The invention may be utilized to provide uniform tip clearance in new or existing installations, particularly where the fan cylinder 20 is either out of round or not concentric with the fan assembly 19.

In accordance with the invention, a plurality of foam spacer panels 34 are secured to the inner surfaces of fan cylinder 20 around the circumference thereof in facing relationship to the fan blades 32. The foam spacer panels 34 are trimmed to the desired thickness by a cutting means 36 which is secured to one of the fan blades 32. A plastic sheet 38 is secured to the trimmed surface of each of the spacer panels 34 in facing relationship to the fan assembly 19.

Figure 3:
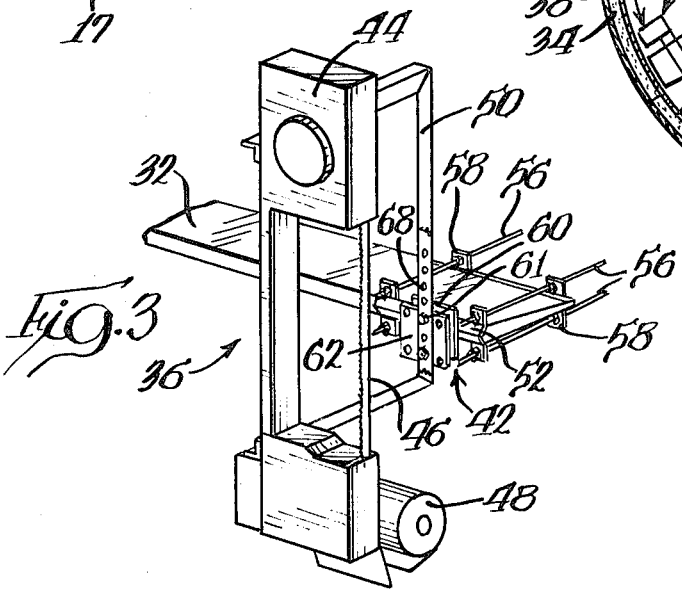
FIG. 3 is a perspective view of the end of one of the fan blades having the cutting means of the present invention attached thereto.
Figure 6:
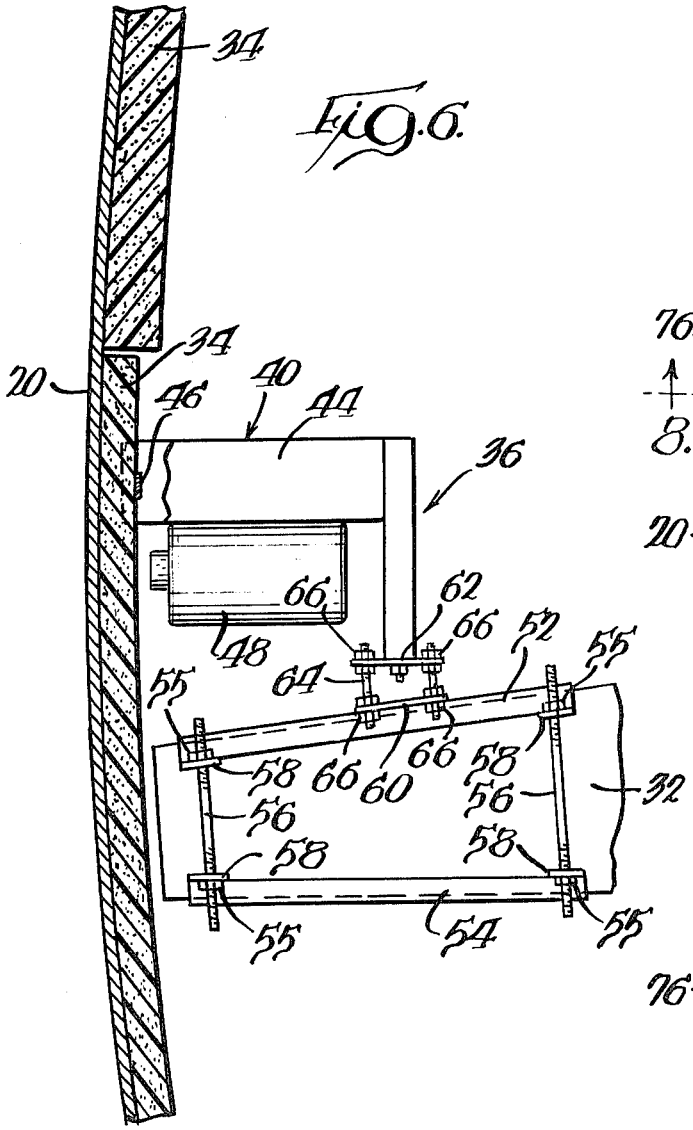
FIG. 6 is an enlarged top plan view, partially in section, of a portion of the fan assembly showing the cutting means secured to a fan blade in position to trim a foam spacer panel in accordance with the invention.
Figure 7:
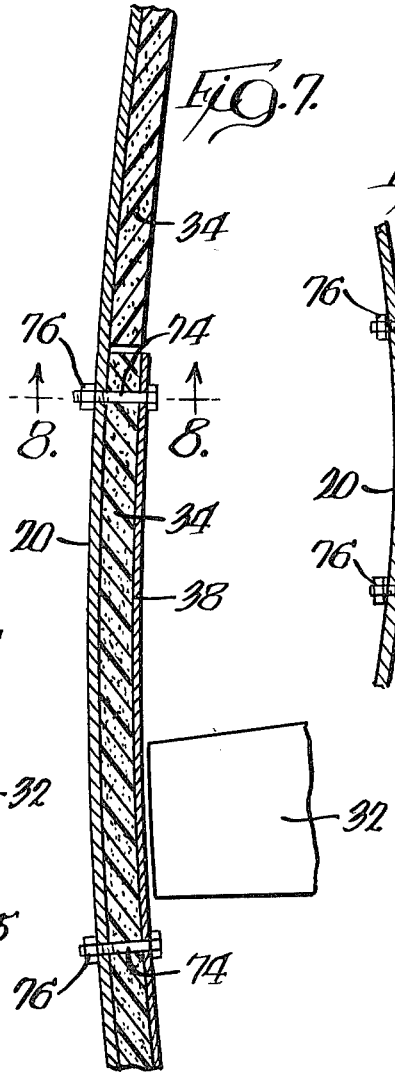
FIG. 7 is a view similar to FIG. 6 showing the portion of the fan assembly after the attachment of the plastic cover sheet.
Figure 8:
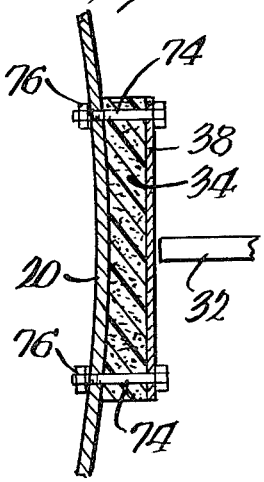
FIG. 8 is a sectional view taken along line 8—8 in FIG. 7.

Referring to FIGS. 3 and 6, cutting means 36 includes a band saw assembly 40, which is attached to a bracket assembly 42 to permit the cutting means to be selectively attached adjacent the end of a fan blade 32. Band saw assembly 40 includes a housing 44 which supports a rotating saw blade 46 which is driven by a motor 48. A C-shaped support bracket 50 extends outward from housing 44. Bracket assembly 42 includes a pair of spaced apart bracket members 52 and 54 which are shaped to sandwich the leading and trailing edges of a fan blade 32 therebetween. The distance between bracket members 52 and 54 is adjusted by threaded rods 56 which extend between and through corresponding tabs 58 that extend above and below the respective ends of bracket members 52 and 54. Bracket member has a plate 60 welded thereto in facing relationship to a plate 62 which is secured to bracket 50. Plates 60 and 62 are spaced apart and secured to each other by threaded rods 64 and nuts 66. Such arrangement permits the plane of plate 62 to be selectively positioned so as to permit the selective orientation of the band saw 40. As seen in FIG. 3, bracket 50 is provided with a plurality of vertically spaced horizontal slots 68 to permit selective adjustment of the elevation and orientation of band saw 40.

Figure 4:
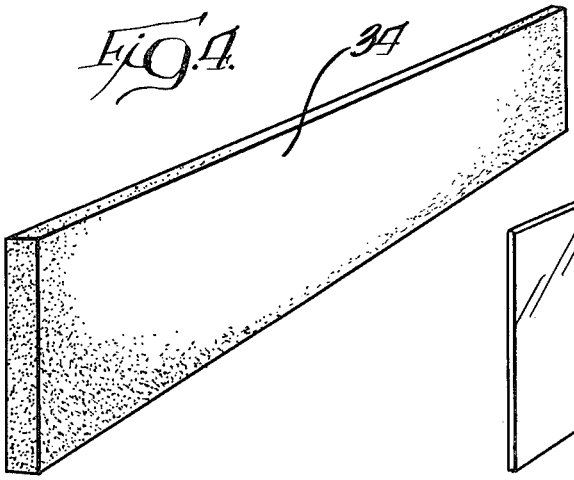
FIG. 4 is a perspective view of the foam spacer panel in accordance with the invention.

Referring to FIG. 4, foam spacer panel 34 is a generally rectangular sheet which typically is approximately eleven inches high and two inches thick. The length of panel 34 varies dependent upon certain relationships which will be hereinbelow further discussed. In accordance with the presently considered preferred embodiment of the invention the panels 34 are constructed of a polyethylene foam material however it is anticipated that alternative foam materials may be used.

Figure 5:
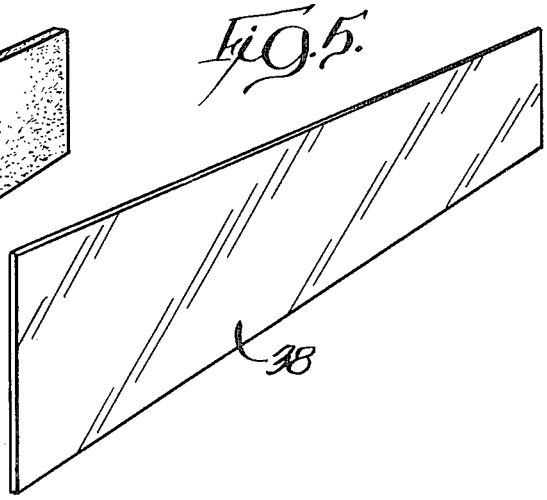
FIG. 5 is a perspective view of the plastic sheet in accordance with the invention.

Referring to FIG. 5, plastic sheet 38 is a generally rectangular sheet which typically is approximately eleven inches high and one-eight inch thick. The length of the sheets 38 is preferably approximately eight feet in length. In accordance with the presently considered preferred embodiment of the invention the sheets 38 are constructed of a fiberglass material, however it is anticipated that alternative materials may be used.

The method and apparatus of the invention will now be further described in conjunction with a discussion of a preferred installation procedure.

Prior to installation of the foam spacer panels 34, the surfaces of the fan cylinder 20 in facing relationship to the fan assembly 19 are cleaned. These surfaces may be cleaned with high pressure hoses, sandpaper, electric grinders, or other known techniques which leave the surfaces free of scale, clean and dry.

For purposes of this discussion, it shall be assumed that the height of the spacer panels 34 are eleven inches. The next step in the installation procedure is to locate the position on the fan cylinder surfaces where the spacer panels are to be secured. This is accomplished by determining the highest and lowest points of all the tips of the fan blades 32 and marking a center line on the surfaces of the fan cylinder between these points. The next step is to scribe a line five and one half inches (one half the spacer panel height) above this center line around the entire circumference of the fan cylinder 20. This line will serve as the guide line to which the top edges of the spacer panels 34 are installed in alignment therewith.

The next step is to determine which of the fan blades 32 is the longest. This is accomplished by measuring the tip clearance of each of the blade at a preselected point on the fan cylinder surface. The point selected is typically a point adjacent the opening of the access door (not specifically shown), which is typically provided in the fan cylinder 20. The cutting means 36 is mounted adjacent the outer end of the longest blade.

Referring to FIGS. 3 and 6, the fan blade 32 is received by the bracket assembly 42 such that the leading and trailing edges thereof are respectively loosely clamped between bracket members 52 and 54. The bracket assembly 42 is then radially adjusted so as to position the saw blade 46 a desired distance radially outward of the tip of the fan blade. In a typical installation this distance is approximately five eights of an inch. With the bracket assembly 42 so positioned, the wing nuts 55 received on rods 56 are tightened to rigidly clamp the bracket assembly 42 to the fan blade. The next step is to adjust the orientation of the band saw assembly 36 to make sure that the saw blade 46 is vertical and parallel with the surfaces of the fan cylinder. This is accomplished by first loosening nuts 61 and tilting the band saw 40 to get the saw blade 46 in a vertical orientation. The nuts 61 are then tightened to maintain the saw blade in its vertical orientation. The next step is to adjust the orientation of plate 62 by loosening and tightening the nuts 66 so as to orient the saw blade 46 with respect to the surfaces of the fan cylinder 20. This is preferably accomplished by adjusting the top nuts 66 vs. the bottom nuts 66 to set the saw blade 46 vertical to this plane and to then adjust the inside nuts 66 vs. the outside nuts 66 to set the saw blade 46 parallel with respect to the surface of the fan cylinder. After the above adjustments it is desirable to again check the clearance of saw blade 46 from the tip of the longest fan blade 32, and if necessary readjust to the desired clearance by loosening wing nuts 55.

With the cutting means 36 so positioned on the longest fan blade 32, the next step is to trim the lengths of the foam spacer panels to the desired length. In accordance with the preferred method of the invention, the length of the spacer panels is preferably equal to or slightly less than the distance between the leading edge of the saw blade 46 and the trailing edge of the adjacent fan blade 32 in the direction of its rotation. This distance is indicated at 70 in FIG. 2. The spacer panels 34 are trimmed to this length, e.g., a twenty eight foot eight blade fan uses spacer panels approximately eight feet in length.

The spacer panels 34 are then installed and trimmed one at a time around the inner surfaces of the fan cylinder 20, typically starting immediately to the left side of the access door opening and working all the way around to the right side of the access door opening. A contact cement is applied to the surfaces of the fan cylinder 20 and to the back of the spacer panels 34. After the cement is allowed to dry until tacky the spacer panels 34 are pressed in place against the inner surfaces of the fan cylinders such the upper edge thereof is in alignment with the scribed line. Each spacer panel 34 is then trimmed by starting the band saw 40 and rotating the fan blade 32 so as to move the saw blade 46 through the spacer panel 34 while drawing the excess or trimmed material through the saw frame. This sequence of steps is repeated for each spacer panel 34 as such are installed around the circumference of the surfaces of the fan cylinder. Also, in a similar manner a spacer panel 34 is installed to the inner surface of the access door.

The plastic sheets 38 are secured to the trimmed face of the spacer panels 34, again starting to the left of the access door and working around the circumference of the fan stack. The sheets 38 are held in place, such that the top and bottom edges thereof are in alignment with the top and bottom edges of the spacer panels 34, and holes are drilled through the sheet 38, the panel 34 and the wall of the fan cylinder 20. These holes are preferably one half inch from the top and bottom edges of the sheet 38 and are spaced at approximately one foot intervals. Bolts 74 extend through the holes and receive nuts 76, which when tightened sandwich the spacer panel 34 between the sheet 38 and the wall of the fan cylinder 20. The bolts 74 are preferably tightened until the sheet 38 just begins to compress the spacer panel 34. The sheets 38 are installed around the circumference of the fan cylinder 20 and are preferably spaced approximately one fourth inch apart to allow for expansion. Also, in a similar manner a sheet 38 is installed on the access door upon providing the necessary clearance by either removing the cutting means 36 or adjusting same inwardly. The sheets 38 serve to insure that no portion of the spacer panels 34 can separate from the fan cylinder 20 should the glue joint fail. The glue is intended to hold only during the trimming operation.

In order to protect the upper edges of the spacer panels 34, a suitable sealant may be brushed or sprayed thereonto. An example of such a sealant is elastomeric polyurethane.

The method and apparatus as hereinabove described provides an inexpensive and easy to install system to adjust the clearance between the tips of the fan blades and the surfaces of the fan cylinder. This system permits the utilization of relatively inexpensive fan cylinders whose dimensions are such that large non-uniform tip clearances occur. It utilizes plastic materials which are not susceptible to corrosion. It conforms to the compound curvature of a hyperbolic fan cylinder without the need of shims or spacers. It may be used to achieve uniform tip clearances in instances where the fan cylinder is out of round or is not concentric with the fan assembly. It eliminates the expensive equipment, adhesion problems, and mess associated with spray-on foams which might be used for tip clearance adjustment. It can be used in new installations or as a retrofit on existing installations. It is positively secured to the fan cylinder to prevent failure and potential damage to the fan assembly.

It will be apparent that the preferred embodiment described above is subject to being modified by one skilled in the art. Accordingly, the invention should be taken as including all such modifications as fall within the spirit and scope of the invention as defined by the following claims.

I claim:

1. A method of adjusting the amount of clearance between the tips of the fan blades of a large axial flow fan and the fan cylinder, comprising the steps of:

(a) glueing a plurality of spacer panels of a foam material construction to the inside surface of the fan cylinder in facing relationship to the tips of the fan blades;

(b) securing a vertically extending cutting means adjacent the tip of at least one of the fan blades, said cutting means having a vertically extending cutting blade which extends outward from the tip of the fan blade by a prselected distance;

(c) rotating the fan blade so as to cause the cutting blade to trim the spacer panels in a sequential manner around the circumference of the fan cylinder and thereby (d) securing a plastic sheet in covering relationship to the trimmed surface of each of the spacer panels by fastening means extending through the plastic sheet, spacer panel and fan cylinder; and (e) applying a sealant material over the top surface of each of the spacer panels.

2. The invention as defined in claim 1 wherein expansion spaces are provided between adjacent plastic sheets.

3. The invention as defined in claim 1 wherein said foam material is polyethylene.

4. The invention as defined in claim 1 wherein the plastic sheet is a fiberglass material.

5. The invention as defined in claim 1 wherein the length of each spacer panel is substantially equal to the distance between the cutting blade and the trailing edge of the adjacent fan blade in the direction of fan rotation.

6. The invention as defined in claim 5 wherein said cutting blade is secured to the longest fan blade and extends radially outward therefrom a distance equal to the desired fan blade tip clearance.

* * * * *